US006397443B1

(12) United States Patent
Good et al.

(10) Patent No.: US 6,397,443 B1
(45) Date of Patent: Jun. 4, 2002

(54) HARNESS STRAND OR LAMELLA FEEDING SYSTEM

(75) Inventors: Thomas Good, Schwendi; Plazi Wenzin; Justus Mullis, both of Flums; Andreas Erhard, Mastrils; Martin Hunziker, Maienfeld, all of (CH)

(73) Assignee: Stäubli AG Pfäffikon, Pfäffikon (CH)

( * ) Notice: Subject to any disclaimer, the term of this patent is extended or adjusted under 35 U.S.C. 154(b) by 0 days.

(21) Appl. No.: 09/787,090

(22) PCT Filed: Aug. 24, 1999

(86) PCT No.: PCT/CH99/00388

§ 371 (c)(1),
(2), (4) Date: May 21, 2001

(87) PCT Pub. No.: WO00/15888

PCT Pub. Date: Mar. 23, 2000

(30) Foreign Application Priority Data

Sep. 14, 1998 (CH) ..... 1864/98

(51) Int. Cl.[7] ..... D03J 1/14
(52) U.S. Cl. ..... 28/206

(58) Field of Search ..... 28/205, 206

(56) References Cited

U.S. PATENT DOCUMENTS 4,891,871 A * 1/1990 Tachibana et al. ..... 28/205
5,448,811 A * 9/1995 Jaeger et al. ..... 28/205

FOREIGN PATENT DOCUMENTS

| | | |
|---|---|---|
| EP | 0 470 538 A1 | 2/1992 |
| EP | 0 683 116 A1 | 11/1995 |
| EP | 0 806 506 A2 | 11/1997 |
| WO | WO 91/05099 | 4/1991 |
| WO | WO 92/05303 | 4/1992 |

* cited by examiner

*Primary Examiner*—Andy Falik
(74) *Attorney, Agent, or Firm*—Venable; Gabor J. Kelemen

(57) ABSTRACT

A device feeds harness elements to a separation station of a drawing-in machine. The device includes at least one feed rail. The harness elements are arranged on the one feed rail. The feed rail has an inclination relative to a horizontal to generate a slope descending force for pressing a respective foremost harness element onto the separating station.

20 Claims, 6 Drawing Sheets

HARNESS STRAND OR LAMELLA FEEDING SYSTEM

BACKGROUND OF THE INVENTION

The invention relates to a device for the feed of harness elements, in particular of healds or droppers, for their subsequent separation in a separating station of a drawing-in machine, the said device having at least one feed rail, on which can be arranged the harness elements, such as healds or droppers, which, in this case, engage with guide elements, such as, for example, guide loops, around the at least one feed rail.

To prepare for weaving, harness elements, such as healds and droppers, must be drawn onto the warp threads by means of a warp drawing-in machine. This is carried out, as a rule, by feeding a stack of the respective harness elements to a separating station. Separating stations of this kind for healds or droppers are already known per se. Although the separating stations for healds differ, as a rule, from those for droppers in their design, they have in common the fact that they in each case extract one harness element, specifically the foremost element in each case, from the harness element stack. A transport means then transports the individual harness element further to another location on the warp drawing-in machine, at which the harness is arranged on a warp thread. In order to ensure that a warp drawing-in machine operates faultlessly, it is therefore important that the harness elements are individually separated from the corresponding stack reliably and at the intended time by the respective separating station and made available for further transport. Within the scope of the present invention, then, it became apparent that the reasons for unsatisfactory operating reliability of separating stations are to be found in the means for feeding to the separating stations.

Devices for feeding healds to a separating station, the healds being guided on a horizontally oriented feed rail, are already known. In order to generate at the separating station a pressure force which is advantageous for the reliable pick-up of individual healds, in the feed device already known, for example from WO 92/05303, a pneumatically actuated presser presses against the heald stack. Since the pneumatically actuated presser is absolutely essential in this device, the design is, on the one hand, comparatively complicated. It became apparent, on the other hand, that, in spite of the presser, the operating reliability of the feed device is not entirely satisfactory.

A disadvantage of the devices already known for feeding droppers is that, likewise, there is no constant pressure force prevailing on the droppers at the separating point. Thus, when a dropper stack is being worked through in a separating station, there are not any constant conditions for separating the foremost droppers in each case. This may be the cause of malfunctions in the automatic separation of the droppers.

BRIEF SUMMARY OF THE INVENTION

The object on which the invention is based is, therefore, to provide devices for feeding harness elements, such as either healds or droppers, into a separating station, the operating reliability of which is improved, as compared with corresponding devices already known.

In a device of the type mentioned in the introduction, this object is achieved, in that the at least one feed rail of the device has an inclination relative to a horizontal, with the result that a slope descending force acts on the harness elements which are arranged with their guide loops preferably directly on the feed rail, as it is mentioned in the combination of features of claim 1.

An important advantage of this solution is that, by virtue of the inclination of the rail, a slope descending force of the harness elements arranged on the feed rail is generated and can be utilized for conveying the harness elements in the direction of the separating station and for pressing the harness elements onto the separating station. It is thereby possible, irrespective of the size of the stack of harness elements, to bring about relatively uniform conditions in respect of the harness elements in the separating station. This contributes to achieving a high degree of operating reliability in the individual separation of the harness elements.

It has proved advantageous, particularly in connection with the separation of healds, if the slant or inclination of the rail in the direction of the separating station corresponds approximately to the coefficient of static or sliding friction between the feed rail and the healds arranged on the rail. A pressure force essentially independent of the weight of the heald stack, for pressing onto the separating station, can thus be generated. In order to ensure this, it is preferable if the angle of inclination of the rail deviates by at most 30%, particularly preferably by at most 20%, from that angle of inclination at which an equilibrium prevails between the weight force of the heald stack and the static or sliding frictional force which is established between the healds and the guide rail during the separation process respectively the feeding of the healds. This condition can be expressed as a formula as follows:

$$F_r \cong F_n * \mu_c,$$

in which: $F_r$=Static frictional force;

$\mu_c$=Coefficient of static friction between the rails and the healds, $F_n$=the component of the weight force $F_G$ which is oriented parallel to a perpendicular to the oblique plane, with $F_n=F_G*\cos\alpha$, and $\alpha$=inclination of the oblique plane relative to a horizontal.

In a further advantageous refinement according to the invention, the device has a slide which presses against the heald stack. Moreover, if the feed rail is provided with the above-described angle of inclination at which an equilibrium at least approximately prevails between the sliding or static frictional force e and the slope descending force, the healds come to bear with an essentially constant pressure force at the separating station. This pressure force arises from the weight force of the slide or of another pressure element and is independent of the weight of the heald stack and therefore of the number of healds.

Preferred refinements of the invention may be gathered from the description blow.

Preferred refinements of the invention may be gathered from the dependent claims.

The invention is explained in more detail with reference to the exemplary embodiments illustrated diagrammatically in the figures of which:

DETAILED DESCRIPTION OF THE INVENTION

Figure 1:
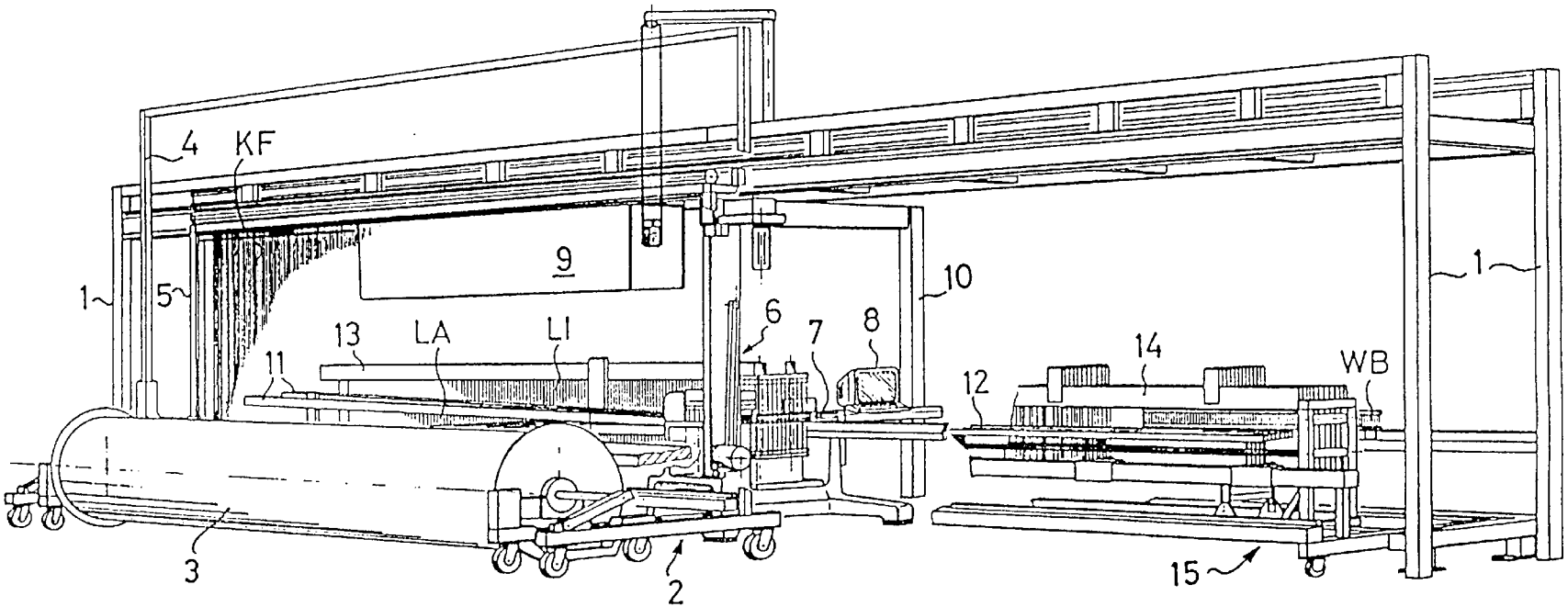
FIG.1 PRIOR ART
FIG. 1 shows a perspective view of a warp drawing-in machine according to CH 682,577.

FIG. 1 shows a warp drawing-in machine. This consists of a basic stand 1 and of various subassemblies which are arranged in the latter and which each form a functional module. A warp-beam carriage 2 with a warp beam 3 arranged on it can be seen in front of the basic stand 1. The warp-beam carriage 3 also contains a lifting device 4 for holding a frame 5, on which the warp threads KF are stretched. For drawing-in, the warp-beam carriage 2, together with the warp beam 3 of the lifting device 4, is moved up to the so-called setting-up side of the drawing-in machine, and the frame 5 is lifted upwards by the lifting device 4 and suspended where it then assumes the position illustrated.

The frame 5 and the warp beam 3 are displaced in the longitudinal direction of the basic stand 1. During this displacement, the warp threads KF are guided past a thread-separating stage 6 and at the same time are separated and divided off. After being divided off, the warp threads are cut off and offered to a drawing-in needle 7 which forms an integral part of the so-called drawing-in module.

Next to the drawing-in needle 7 can be seen a video display unit 8 which belongs to an operating station and serves for indicating machine functions and machine malfunctions and also for data input. The operating station is part of a so-called programming module and also comprises an input stage for the manual input of particular functions and sequences. The drawing-in machine is controlled by means of a control module which comprises a control computer and is arranged in a control box 9. This control computer preferably comprises, for each functional module, an individual module computer which is controlled and monitored by the control computer. The main modules of a drawing-in machine also include, in addition to the modules already mentioned, the heald module, dropper module and reed module.

The thread-separating stage 6, which offers to the drawing-in needle 7 the warp threads KF to be drawn in, and the path of movement of the drawing-in needle 7, which runs vertically relative to the plane of the stretched warp threads KF, define a plane which separates the setting-up side already mentioned from the so-called setting-down side of the drawing-in machine. On the setting-up side, the warp threads and individual harness elements, that is to say the healds or droppers, into which the warp threads are to be drawn, are fed. On the setting-down side, the so-called harness (healds, droppers and reeds), together with the drawn-in warp threads, can be extracted. Directly behind the plane of the warp threads KF are arranged the warp stop motion droppers LA, behind these the healds LI and, even further behind, the reed. The droppers are stacked in hand magazines and are transferred to a feed device according to the invention which is described in more detail below. After being drawn in on to a warp thread, the droppers reach the setting-down side on dropper carrying rails 12.

The healds LI are lined up and automatically displaced to a separating station in a further feed device according to the invention which is likewise to be explained in more detail below. In this separating station, the healds are brought individually into their draw-in position and, after the warp threads have been drawn in, are distributed to the corresponding heald shafts 14 on the setting-down side.

The reed is likewise moved in steps past the drawing-in needle, the corresponding reed dent being opened for the draw-in. After the draw-in has taken place, the reed WB (partially illustrated on the right next to the heald shafts 14) is likewise on the setting-down side.

Provided on the setting-down side is a so-called harness carriage 15. The latter, together with the carrying members fastened on it, specifically the dropper carrying rails 12, heald shafts 14 and a holder for the reed, is pushed into the basic stand into the position illustrated and, after drawing-in has taken place, carries the harness together with the warp threads.

The functions described are distributed to a plurality of modules which constitute virtually autonomous machines or systems which are controlled by the common control computer. The main modules of the drawing-in machine which have already been mentioned are preferably themselves again of modular design and comprise submodules. This modular design is described in Swiss Patent number CH 679,871, the disclosure of which is hereby expressly incorporated by reference.

FIG. 1 is to be understood as being purely illustrative: the warp drawing-in machine, in which the device according to the invention for receiving, holding and feeding harness elements is to be installed, for example as a module, may differ considerably, as a whole or else in detail, from the machine illustrated in FIG. 1.

Figure 2:
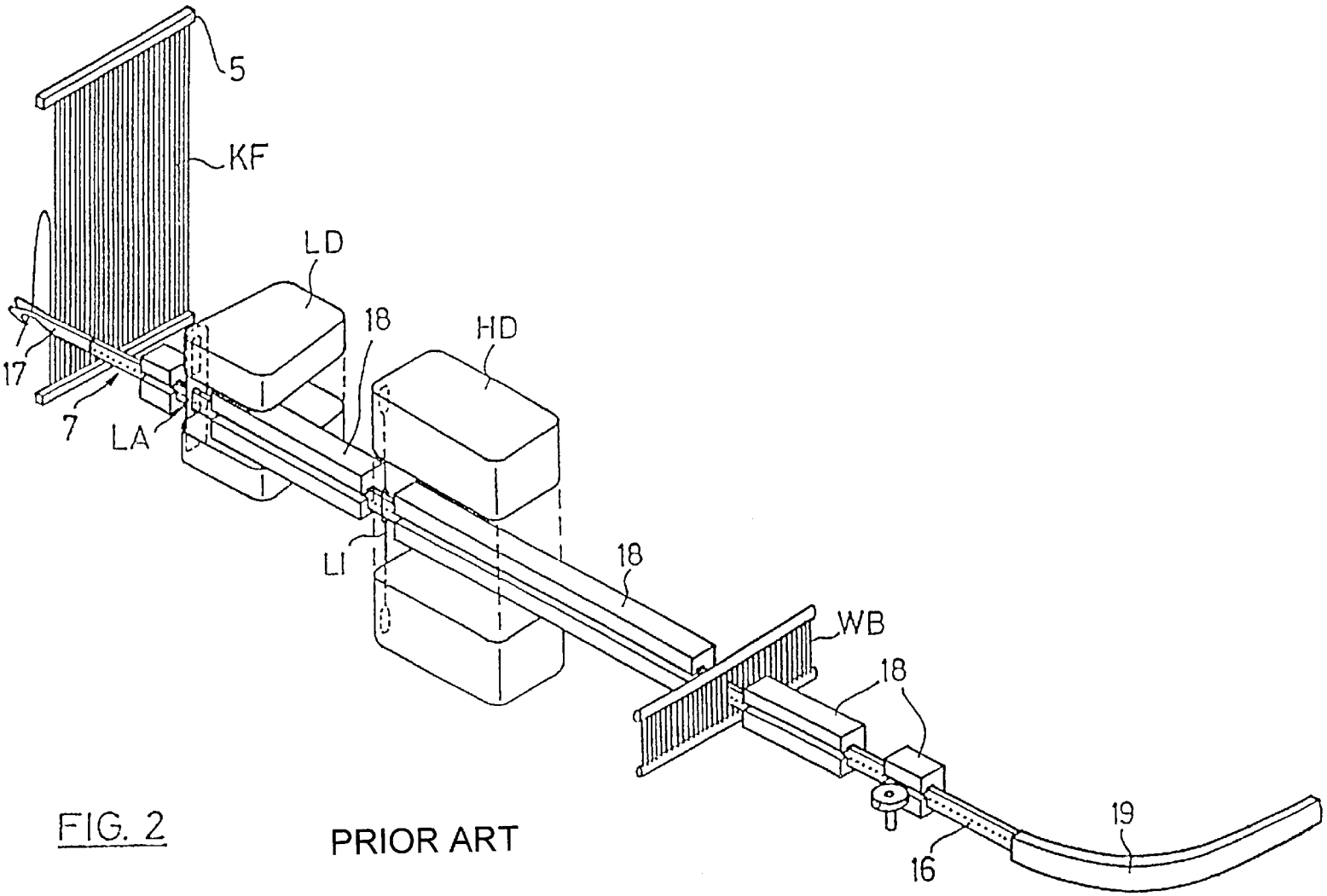
FIG. 2 PRIOR ART
FIG. 2 shows an example of a draw-in module of a warp drawing-in machine.

As may be gathered from FIG. 2, the drawing-in needle 7, which forms the main integral part of the draw-in module, comprises a gripper band 16 and a clamping gripper 17 carried by the latter. The drawing-in needle 7 is guided in the stroke direction (arrow P) in a channel-like guide 18 which extends from the frame 5 in a rectilinear direction as far as an arcuate end part 19. The guide 18 passes through the drawing-in machine and, in the region of the harness elements (droppers LA, healds LI) and of the reed WB, is interrupted in each case, in order to make it possible to feed the harness elements to the draw-in position and, after drawing-in has taken place, transport them further as far as the transfer (arrow S) to the carrying members (dropper carrying rails 12 and heald shafts 14) and also to draw the warp threads into the reed WB (so-called reeding).

The feed of the droppers LA and of the healds LI to their draw-in position and the further transport of these as far as transfer to the respective carrying members is carried out by means of a dropper distribution submodule LD and heald distribution submodule HD respectively. In order to ensure that the two submodules operate reliably, it is necessary for the respective harness elements to be fed to them individually and at the correct time, the present invention contributing to this. The two submodules LD and HD perform basically the same functions, in that they receive harness elements offered sequentially or in steps to them, transport these to the draw-in point and, after warp draw-in has taken place, transport them further to a transfer point, where transfer to the carrying members, that is to say the dropper carrying rails 12 or heald shafts 14, takes place.

Figure 3A:
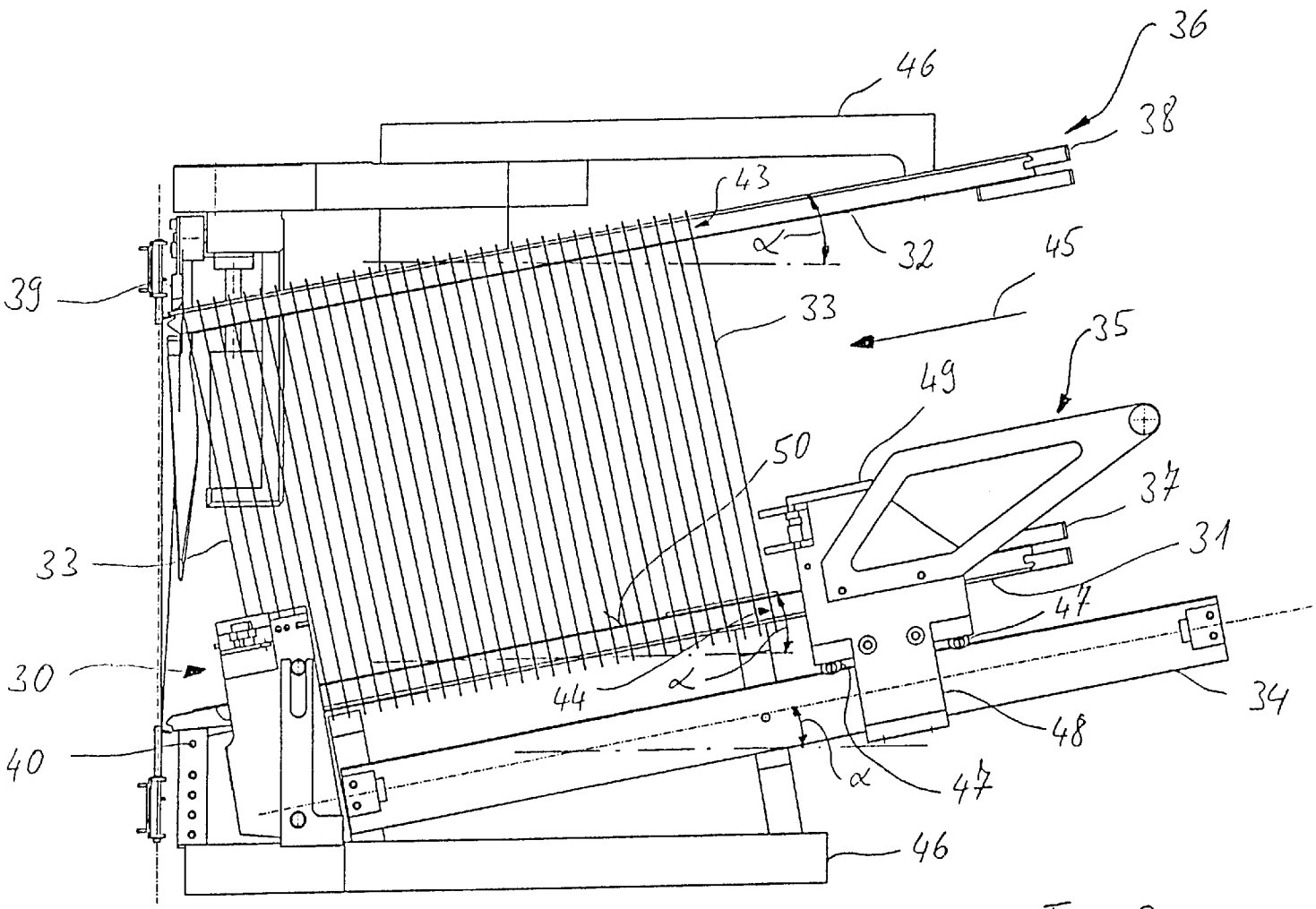
FIG. 3*a* shows a side view of a feed device according to the invention for healds.

FIG. 3*a*, then, shows a device for feeding healds LI to a separating station 30. This device has a lower and an upper feed rail 31, 32 for guiding the healds. In addition to the two feed rails 31, 32, the device is provided with a third rail in the form of a guide rail 34 for a slide 35, the said guide rail being located below the lower feed rail 31. In an initial state, all three rails are oriented essentially parallel to one another. In this case, the three rails each have the same angle of inclination ($\alpha$) which, in the exemplary embodiment illustrated, is 10°. As a result of the inclination, the two feed rails 31, 32 are oriented in such a way that they-are inclined downwards from an introduction end 36 towards the separating station 30 which is illustrated highly diagrammatically. The feed rails 31, 32 thus maintain an inclination as far as or into the separating station 30.

Fastened in each case to the upper introduction ends 36 of the two feed rails 31, 32 is a coupling element 37, 38, to which hand magazines (not illustrated) for heald stacks can be fastened releasably. The coupling elements 37, 38 thus make it possible to transfer a heald stack from a hand magazine onto the feed rails 31, 32. Mounted in the region of the lower separating end of the upper feed rail 32 is a stopper 39 which, on the one hand, prevents healds 33 from falling down from the feed rail 32. On the other hand, the stopper 39 assists in positioning the first heald in each case in the separating station 30.

Figure 5:
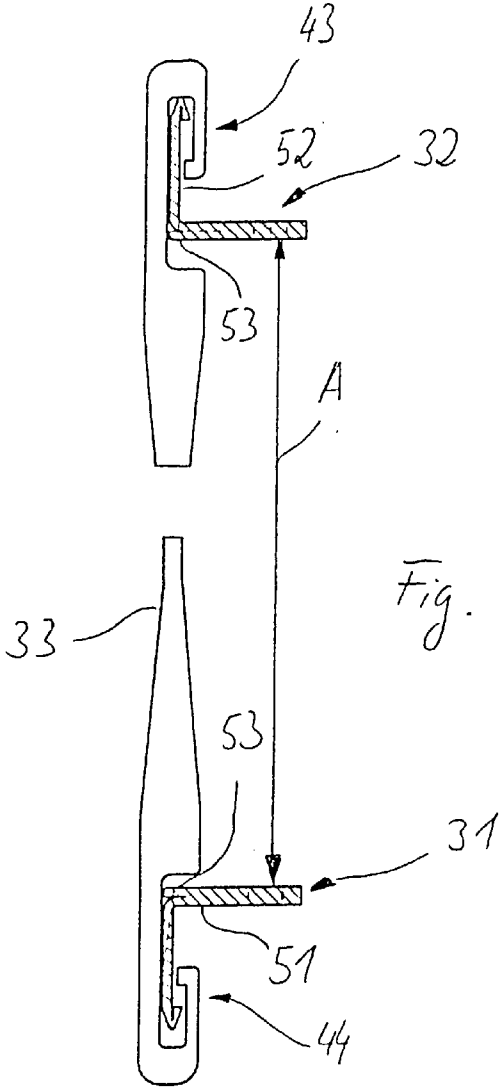
FIG. 5 shows a cross-sectional illustration of a further example of two feed rails of the device from FIG. 3*a;*
Figure 4:
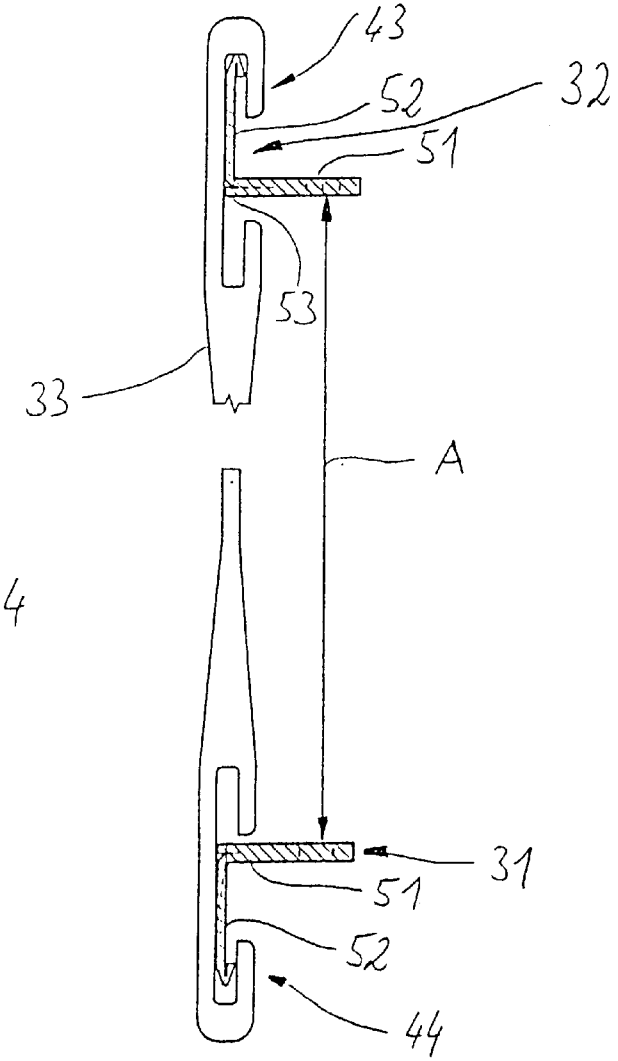
FIG. 4 shows a cross-sectional illustration of an example of two feed rails of the device from FIG. 3*a;*

The distance A between the two feed rails 31, 32, which run parallel to one another in the heald-free state, is selected in such a way that the healds, introduced in each case with their upper and lower guide loops 43, 44 on the two feed rails 31, 32, can move essentially on the rails, without catching or jamming (cf. FIGS. 4 and 5). In order to make this possible, the feed rails 31, 32 are at a distance from one another such that the healds can move at least slightly within the drawing plane of FIG. 3*a* and essentially vertically relative to the direction of transport, indicated by the arrow 45, of the healds on the feed rails. The direction of transport runs parallel to the longitudinal axes of the rails.

As illustrated in FIG. 3*a*, the two feed rails 31, 32 and the guide rail 34 are fastened to a stand 46 which is connected to the warp drawing-in machine. In this case, the lower feed rail 32 is mounted-on the stand rotatably about an axis of rotation 40 oriented vertically relative to the drawing plane. The axis of rotation 40 is located between the guide rail and the feed rail 31 in the region of the lower end of the said feed rail 31 and therefore also in the region of the separating station 30. The feed rail 31 is provided with a compression spring, not illustrated in any more detail, which acts counter to the weight force G of the feed rail. As seen from the axis of rotation and in the longitudinal direction of the feed rail, the spring engages behind the centre of gravity of the feed rail 31. As a result, a lever arm $D_1$, with which the weight force G of the feed rail 31 rotates about the axis of rotation 40, is lower than the lever arm $D_2$, with which the spring force $F_F$ generates a moment with respect to the axis of rotation 40. The spring force $F_F$ is, in this case, dimensioned in such a way that an equilibrium of moments with respect to the axis of rotation 40 at least approximately prevails by virtue of the weight force G and the spring force $F_F$. In other words, the equation $F_G{*}D_1 \cong F_F{*}D_2$ is true. It would, of course, be possible for the force counteracting the weight force also to be generated in a way other than by means of the compression spring described.

What may be achieved by this measure is that the inclination of the lower feed rail 31 is adapted to the orientation of the heald stack. Particularly where healds 33 which have already been used more than once are concerned, it is perfectly possible that the healds 33 may be deformed. The result of this may be that healds 33 of the stack are not arranged orthogonally, but askew, in relation to the upper feed rail 31, as is the case, in the heald stack in FIG. 3*b*, with regard to the healds 33 of the stack which are at the rear in the direction of transport. The corresponding healds of the stack therefore tend to catch with one of their guide loops on one of the feed rails, with the result that the pressure force necessary for transporting these healds on the feed rails 31, 32 increases. The above-described suspension of the lower feed rail 31, then, leads to a situation where healds running askew in relation to the upper feed rail 32 lift the lower feed rail 31 with their lower guide loops and rotate it through a certain angle of rotation about the axis of rotation 40. An angle of inclination $\alpha_1$ deviating from the angle $\alpha$ is thus established at the feed rail 31. The force required for this purpose is relatively slight because of the essentially "floating" suspension of the feed rail. As a result, the two feed rails are oriented parallel to one another only when there are no healds 33 arranged on the feed rails 31, 32 or when all the healds of a stack are oriented orthogonally to both feed rails 31, 32.

The above-explained suspension of at least one of the two feed rails 31, 32 counteracts a catching of the healds 33 on the rails and contributes to ensuring that the pressure force of the foremost heald of the stack against the separating station remains approximately constant in each case. It has been shown that an increase in inclination of up to approximately 15° per 1 m of length of the heald stack is brought about by means of this suspension.

Figure 3B:
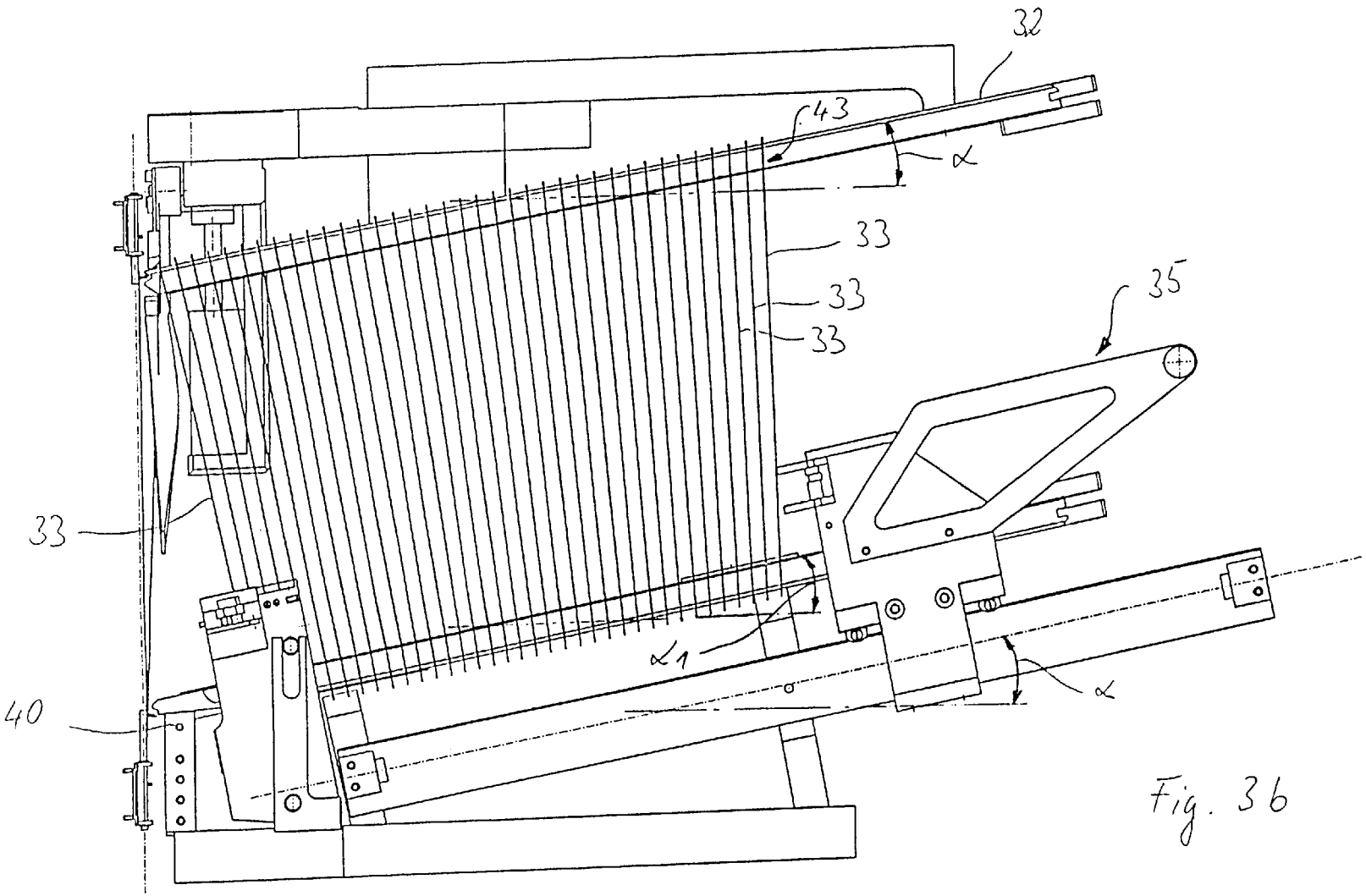
FIG. 3*b* shows the feed device of FIG. 3*a* with a trapezoidal heald stack.

As shown in FIGS. 3*a* and 3*b*, the slide 35 is arranged moveably on the guide rail 34, for which purpose the said slide is supported on the guide rail 34 via rolling bearings, specifically three rollers 47. The slide 35 has a first C-shaped bracket 48 which engages round the guide rail 34 and guides the slide 35 on the guide rail. The slide 35 presses with a second bracket 49, which projects over a top side 50 of the lower feed rail 31, against the heald of a heald stack which is the last in the direction of transport 45. The conveying force which is achievable by means of the slide 35, and which, moreover, may be utilized as a pressure force pressing the first heald in each case onto the separating station 30, is derived essentially from the inclination of the two rails 32, 34, the mass of the slide 35, the mass of the heald stack, the friction between the healds 33 and the feed rails 31, 32 and the friction between the slide 35 and the guide rail 34. Since, in the exemplary embodiment shown, the inclination and therefore also the slope descending force is substantially greater than the resultant from the rolling friction of the slide 35 and the friction of the healds 33 on the two feed rails 31, 32, a force in the direction of transport is obtained, which is utilized for conveying the healds 33.

It has been shown that specific profile shapes of the feed rails 31, 32 contribute to avoiding jamming of the healds on the feed rails. Thus, the L profile shown in FIGS. 4 and 5 has proved favourable, specifically irrespective of whether the healds shown in the figures are of the so-called C-type or J-type. As may be gathered from these figures, on the upper feed rail 32 a vertical leg of a canted profile of the L-profile shape points upwards, whilst, on the lower feed rail 31, the said leg points downwards. In order to obtain as sharp an edge as possible at the transition between the horizontal leg 51 and the vertical leg 52, it has proved favourable if the horizontal leg 52 of the canted profile has welded onto it a sheet-metal strip 53 which covers the canted rounding. It has been shown that this measure makes it possible to improve the guidance property of the rails.

In order to separate a heald stack, the latter is first pushed onto the two feed rails 31, 32, for which purpose the slide 35 has to be shifted back as far as the end of its guide rail 34. Since the guide rail projects, in the region of the introduction ends 36, beyond the two feed rails 31, 32 of essentially the same length, in this position the slide releases the lower feed rail 31 for healds to be pushed onto it. After the healds have been lined up with their upper loop 43 on the upper feed rail 32 and with their lower loop 44 on the lower feed rail, the healds slip essentially automatically in the direction of the separating station 30 by virtue of a state of equilibrium which approximately prevails between the static frictional force of the healds 33 on the rails 31, 32 and their own slope descending force. The slide 35 can subsequently be released, with the result that the latter rolls onto the heald stack. As already described above, the pressing of the slide onto the heald stack yields a constant force which results in an essentially constant pressure force pressing the first heald of the stack in each case onto the separating station, specifically irrespective of the number of healds in the stack.

Figure 6:
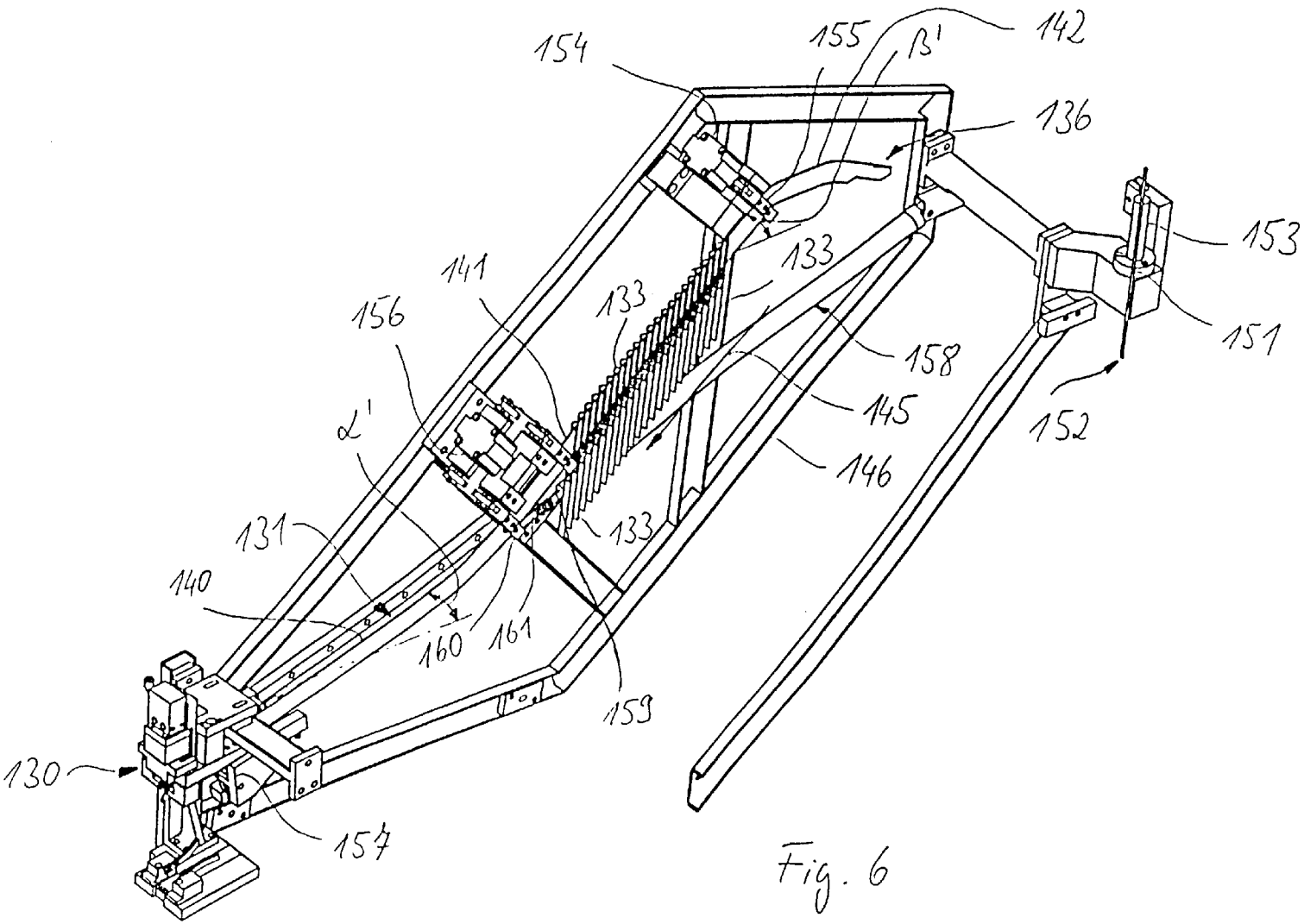
FIG. 6 shows a feed device according to the invention for droppers.

FIG. 6, then, illustrates a device according to the invention for the feed and storage of droppers 133. The device has a feed rail 131 which is provided with a first and a second portion 140, 141. The two portions 140, 141 are inclined relative to a horizontal at different angles of inclination $\alpha'$ and $\beta'$. Moreover, with the exception of the transitions from one portion to the other, the angles of inclination $\alpha'$, $\beta'$ are constant. The portion 141 thus maintains its angle of inclination $\alpha'$ as far as the end of the feed rail 131 in the separating station 130. In the exemplary embodiment illustrated, the angle of inclination $\alpha'$ is approximately 20° and the angle of inclination $\beta'$ approximately 42°.

In the region of an upper end, the introduction end 136, there is an essentially horizontal third portion 142 of the feed rail. A pivoting rail 151 may be added with its free end 152 to this end of the feed rail 131. The other end of the pivoting rail is fastened in a pivot mounting 153, by means of which the pivoting rail 151 is pivotable in an essentially horizontal plane. Both the pivoting rail 151 and the feed rail 131 are held on a common stand 146 which, in turn, may be mounted on a warp drawing-in machine.

A first entry lock 154 is arranged in the region of a transition from the essentially horizontal portion 142 into the portion 141 having the greatest inclination. This entry lock 154 has a pneumatically actuable clamping arm 155 which, in a first end position, bears on the feed rail 131 and, in a second end position, is arranged at a distance from the feed rail 131. In the first end position, the clamping arm therefore retains droppers, whereas, in its second end position, it allows the droppers to be transported further in the direction of the separating station 130. A second entry lock 156 is provided in the region of the transition from the portion 141 having the greater angle of inclination $\beta'$ to the portion 140 having the lesser angle of inclination $\alpha'$. A third entry 157 lock is arranged in the region of that end of the feed rail which is located in the separating station. Both the second and the third entry lock 156, 157 have a shut-off member which is comparable to the clamping arm of the first entry lock and which can be arranged in two end positions. As in the case of the first entry lock 154, the respective shut-off members of the second and third entry locks 156, 157, in their first end position, shut off the rail against a feed of the droppers downstream of the respective entry lock, as seen in the direction of transport. In other words, in this end position, the entry locks retain the droppers which are arranged on the rail upstream of them, as seen in the direction of transport.

The entry locks are designed in such a way that the shut-off members, in their first end position, in each case clamp the feed rail 131, with the result that the latter can be held only by one entry lock. The feed rail not fastened directly to the stand is therefore held only by the entry locks, specifically, depending on the switching state of the entry locks, by one or more of the three entry locks 154, 156, 157. The entry locks are switched in such a way that, even during the change-over operations, always at least one entry lock 154, 156, 157 clamps the feed rail.

A likewise pivotable presser 158 is arranged on the same transverse strut of the stand to which the pivoting rail 151 is also fastened. In the exemplary embodiment illustrated, the presser 158 has a hydraulically actuable pressure cylinder which is actuated by means of a central control of the drawing-in machine. Arranged at the free end of the piston 159 of the presser 158 is a pressing element 160, by means of which the presser 158 presses against the last dropper of a dropper stack which is located downstream of the second entry lock 156, as seen in the direction of transport 145. Finally, the cylinder of the presser has arranged on it a preferably inductive sensor 161, by means of which the presence of droppers 133 and/or a specific size of a dropper stack can be detected on the feed rail 131. Alternatively, there can also be provision for the sensor to detect a specific piston position which corresponds to a specific remaining number of droppers 133. When this position is reached, the sensor transmits a signal to the control.

In further alternative embodiments, a slide can also be provided, in a similar way to the exemplary embodiment of FIG. 3*a*, instead of the pneumatic presser. This slide could be guided on a separate guide rail and press solely with its own weight against the dropper stack. In order to achieve an essentially constant pressure force, it is preferable, here too, if the slope descending force resulting from the weight force of the slide as a whole is equal to or greater than frictional forces between the slide and its rail and between the droppers and the feed rail 131. In this case, the angle of inclination $\alpha'$ of the first portion 140 of the feed rail is preferably selected in such a way that the slope descending force of the droppers on the rail, which results from the weight force, corresponds essentially to the static frictional force between the metallic droppers 133 and the metallic feed rail 131.

In order to ensure that a warp drawing-in machine operates essentially continuously and therefore independently of the follow-up of a new dropper stack, the following procedure may be adopted in provisioning the device according to the invention, shown in FIG. 6, and in the storage of droppers. Even while a dropper stack resting against the separating point in the separating station 130 is being worked through, a new dropper stack is lined up on the pivoting rail 151 and prepared to be transferred onto the feed rail 131. By the pivoting rail 151 being pivoted in onto the portion 142 of the feed rail, this dropper stack can then be transferred onto the feed rail 131. Since the first entry lock 154 is in its shut-off position at this moment, the new dropper stack is retained by this entry lock. At this moment, the second entry lock 156 is likewise closed and the third entry lock 157 is open. The first entry lock 154 is opend when it is ensured that the second entry lock 156 is indeed closed. This makes it possible to feed the new dropper stack before the second entry lock 156.

During this procedure the presser 158 presses against the dropper stack resting against the separating point further on. Whenever a dropper is extracted from the dropper stack, the presser 158 undergoes an advance which corresponds approximately to the thickness of a dropper. As soon as the sensor 161 of the presser 158 responds, the said sensor transmits a signal to the control (not illustrated) of the drawing-in machine. The sensor transmits its signal, for example, when the separating station 130 has essentially worked through the dropper stack hitherto located upstream of the separating point. By virtue of this signal from the sensor, the third and first entry locks 154, 157 are subsequently closed and the second entry lock 156 is opened. Since the feed rail 131 has, upstream of the second entry lock 156, an inclination by virtue of which the dropper stack can move, solely by its own weight, on the rail 131 in the direction of transport, the new dropper stack slips as far as the third entry lock 157 and rests against the shut-off member of the latter. The dropper stack, then, is located between the third and the second entry locks 157, 156. The second entry lock 156 is subsequently closed and the third and first entry locks 157, 154 are opened. The first and second entry locks 154, 156 are thus ready again to receive from the pivoting rail 151 a further dropper stack which may be stored on the feed rail 131 as a dropper stack supply.

The presser 158 is meanwhile moved back to the end of the dropper stack then arranged in front of the separating station 130. By means of a subsequent pivoting-in movement in the direction of the feed rail 131 and a slight advance in the direction of transport 145, the presser is brought to bear against the dropper stack. The presser then presses with a specific force against the dropper stack. The magnitude of the force is dimensioned in such- a way that the separating station 130 can reliably take up the foremost dropper in each case (and only this dropper) and transport it further. So that the foremost dropper in each case rests with the same force against the separating station while the entire dropper stack is being worked through, the presser, by virtue of its advancing movement, always presses with a constant force against the dropper stack after each extraction of a dropper. Due to the inclination of the first portion 140 of the feed rail of approximately 20°, the frictional force between the dropper stack and the feed rail can be essentially cancelled, but at least greatly minimized, on account of the slope descending force of the dropper stack. This therefore results, for every dropper of the stack which is the first in each case, in the same pressing force pressing the said dropper onto the separating station 130. After each dropper of the stack has been separated and the sensor 161 responds again, the cycle described above starts from the beginning.

What is claimed is:

1. A device for feeding harness elements to a separation station of a drawing-in machine, the device comprising:

at least one feed rail, the harness elements being arranged on the at least one feed rail such that a respective foremost harness element is closest to the separation station, wherein the at least one feed rail has an inclination relative to a horizontal to define an angle of inclination and to generate a slope descending force for pressing the respective foremost harness element onto the separation station.

2. The device of claim 1, wherein the harness elements are at least one of healds and droppers.

3. The device according to claim 1, wherein the at least one feed rail has an angle of inclination corresponding to a coefficient of sliding or static friction between the harness elements and the at least one feed rail.

4. The device according to claim 3, wherein the angle of inclination corresponds directly to the coefficient of sliding or static friction between the harness element and the at least one feed rail.

5. The device according to claim 1, wherein the at least one feed rail is articulated pivotably about an axis of rotation to vary the angle of inclination.

6. The device according to claim 5, wherein the weight of the at least one feed rail generates a first torque about the axis of rotation, and wherein the device further comprises means for generating a second torque to counteract the first torque.

7. The device according to claim 1, wherein each of the harness elements have an upper guide loop and a lower guide loop, and wherein the at least one feed rail comprises a first feed rail and a second feed rail, the upper guide loop of each harness element being arranged on the first feed rail and the lower guide loop being arranged on the second feed rail.

8. The device according to claim 1, further comprising a coupling element provided on the at least one feed rail for storing the harness elements.

9. The device according to claim 1, further comprising a slide arranged on the at least one feed rail, the slide exerting a pressure force on the harness elements.

10. The device according to claim 9, wherein the slide is arranged such that the pressure force consists of at least part of the weight of the slide.

11. The device according to claim 9, further comprising roller bearings, the slide being guided on the at least one feed rail via the rolling bearings.

12. The device according to claim 1, wherein the at least one feed rail has an upper end and a lower end, the lower end being inclined relative to a horizontal, and wherein the separating station is arranged at the lower end of the at least one feed raid.

13. The device according to claim 1, wherein the angle of inclination is such that the slope descending force is approximately equal a frictional force between the at least one feed rail and the harness elements, and wherein the device further comprises a pressing element for pressing on the harness elements with an essentially constant pressing force that is independent of the number of harness elements arranged on the at least one feed rail, said pressing force consisting of the weight of the pressing element.

14. The device according to claim 1, further comprising at least one switchable entry lock arranged on the at least one feed rail, the at least one entry lock being provided with a shut-off member with at least a first end position and a second end position, wherein, in a first end position, a stack of harness elements can be retained and stored on the feed rail and, in a second end position, the entry lock releases the feed rail for transporting the retained stack of harness elements.

15. The device according to claim 14, further comprising a central control, and wherein the at least one switchable entry lock comprises three switchable entry locks coordinated by the central control.

16. The device according to claim 1, wherein the at least one feed rail has portions with differing angles of inclination.

17. The device according to claim 16, wherein the portions of the at least one feed rail comprise a first portion and a second portion located downstream of the first portion, said first portion having a greater inclination than the second portion.

18. The device according to claim 17, wherein the first portion has an angle of inclination in of $90° > \alpha > 15°$ and the second portion has an angle of inclination of $45° > \alpha > 0°$.

19. The device of claim 18, wherein the second portion has an angle of inclination of $30° > \alpha > 10°$.

20. A process for drawing warp threads onto harness elements utilizing the device of claim 1.

* * * * *